US010211010B2

(12) United States Patent
Wu

(10) Patent No.: US 10,211,010 B2
(45) Date of Patent: Feb. 19, 2019

(54) KEYBOARD SWITCH EMPLOYING A RESISTANCE STRAIN GAUGE

(71) Applicant: DONGGUAN CITY KAIHUA ELECTRONICS CO., LTD, Tangxia Town, Dongguan (CN)

(72) Inventor: Fuxi Wu, Dongguan (CN)

(73) Assignee: DONGGUAN CITY KAIHUA ELECTRONICS CO., LTD., Tangxia Town, Dongguan (CN)

( * ) Notice: Subject to any disclaimer, the term of this patent is extended or adjusted under 35 U.S.C. 154(b) by 0 days.

(21) Appl. No.: 15/893,848

(22) Filed: Feb. 12, 2018

(65) Prior Publication Data

US 2018/0166231 A1 Jun. 14, 2018

Related U.S. Application Data

(63) Continuation of application No. PCT/CN2016/094101, filed on Aug. 9, 2016.

(30) Foreign Application Priority Data

Aug. 19, 2015 (CN) ..... 2015 1 0509245

(51) Int. Cl.
*G05G 9/047* (2006.01)
*H01H 13/00* (2006.01)
(Continued)

(52) U.S. Cl.
CPC ..... *H01H 13/705* (2013.01); *H01H 13/00* (2013.01); *H01H 13/14* (2013.01);
(Continued)

(58) Field of Classification Search
CPC ..... H01H 13/705; H01H 13/00; H01H 13/14; H01H 13/20; H01H 2239/052; G05G 2009/04744; G05G 2009/04762
See application file for complete search history.

(56) References Cited

U.S. PATENT DOCUMENTS 4,782,327 A * 11/1988 Kley ..... G05G 9/047 250/221
5,278,557 A 1/1994 Stokes et al.
(Continued)

FOREIGN PATENT DOCUMENTS

| | | |
|---|---|---|
| CN | 204288138 | 4/2015 |
| CN | 105185635 | 12/2015 |
| CN | 204884968 | 12/2015 |

OTHER PUBLICATIONS

International Search Report filed in PCT/CN2016/094101 dated Nov. 22, 2016.

*Primary Examiner* — Vanessa Girardi

(74) *Attorney, Agent, or Firm* — Rankin, Hill & Clark LLP

(57) ABSTRACT

A keyboard switch includes a base (1), a resistance-type pressure sensor (5) installed on the base (1), a spring (3) arranged in the base (1) and capable of being pressed on the resistance-type pressure sensor (5), a button (4) which presses the spring (3) and is in sliding fit with the base (1), and an upper cover (2) which presses the button (4) and is adaptive to the base (1). The resistance-type pressure sensor (5) includes two terminals (53) and an elastic sensitive element (51), the elastic sensitive element (51) being internally provided with a resistance strain gauge (52), and two leads (54) extending outwards from the resistance strain gauge (52); one ends of the two terminals (53) are respectively connected to the two leads (54), and the other ends of the two terminals (53) are separately connected to a PCB (6).

13 Claims, 8 Drawing Sheets

(51) Int. Cl.
*H01H 13/14* (2006.01)
*H01H 13/20* (2006.01)
*H01H 13/705* (2006.01)

(52) U.S. Cl.
CPC ... *H01H 13/20* (2013.01); *G05G 2009/04762* (2013.01); *H01H 2231/002* (2013.01); *H01H 2235/01* (2013.01); *H01H 2239/052* (2013.01)

(56) References Cited

U.S. PATENT DOCUMENTS 5,754,167 A * 5/1998 Narusawa ..... G05G 9/047 345/161
8,963,744 B2 * 2/2015 Griffin ..... H01H 13/84 341/22
8,981,246 B2 * 3/2015 Sano ..... H01H 13/14 200/246
9,368,300 B2 * 6/2016 Casparian ..... H01H 13/83

* cited by examiner

KEYBOARD SWITCH EMPLOYING A RESISTANCE STRAIN GAUGE

CROSS-REFERENCE

This application is a continuation of International Patent Application No. PCT/CN2016/094101, filed on Aug. 9, 2016, which claims priority to Chinese Patent Application No. 201510509245.1, filed with the Chinese Patent Office on Aug. 9, 2015, and entitled "KEYBOARD SWITCH", both of the aforementioned patent applications are herein incorporated by reference in their entireties.

FIELD OF THE INVENTION

The present application relates to the field of keyboards, especially to a keyboard switch.

BACKGROUND OF THE INVENTION

As computers develops and computer software updates and upgrades continuously, computer entertainments, such as games, have been essential parts of computers. For most computer gamers, mechanical shaft keyboards are mostly used for pursuing comfortable and fast hand feeling while playing computer games; therefore, mechanical shaft keyboards have been a priority selection for computer gamers. Two electrodes of the current mechanical shaft switch utilize metal contacts which adopt frictional contact, which belongs to resistance-type current conduction mode. The metal contacts are subjected to continuous frictional contact during operation, therefore, this type of mechanical shaft keyboards would have bad contacts resulted from contact deformation and oxidation, which would make the keyboard a dud; furthermore, this type of mechanical shaft keyboards are not capable of turning on or off the power supply, or regulating moving speed of a person or an object in a computer game, which is insufficient in universality.

SUMMARY OF THE INVENTION

One object of the present application is to provide a keyboard switch for overcoming the problems above.

Therefore, the present application provides the following technical solutions: A keyboard switch includes a base, a resistance-type pressure sensor installed on the base, a spring arranged in the base and capable of being pressed on the resistance-type pressure sensor, a button which presses the spring and is in sliding fit with the base, and an upper cover which presses the button and is adaptive to the base, in which the resistance-type pressure sensor includes two terminals and an elastic sensitive element, the elastic sensitive element being internally provided with a resistance strain gauge having a resistance value directly proportional to a pressure applied to the elastic sensitive element, and two leads extending outwards from the resistance strain gauge; one ends of the two terminals are respectively connected to the two leads, and the other ends of the two terminals are both connected to a PCB.

Preferably, the resistance strain gauge is a wire strain gauge or a foil strain gauge.

Furthermore, the resistance strain gauge is a wire strain gauge.

Furthermore, the resistance strain gauge is made of silver wire which is typographically fixed in the elastic sensitive element.

As a preferred solution, the button includes a button core, a force application shaft for applying force on the button being arranged above the button core, and a receiving cavity for receiving an upper end of the spring being arranged at a lower end of the button core; a spring locating shaft is arranged in the receiving cavity, one end of the spring locating shaft being connected to the button core, and the other end of the spring locating shaft protruding into the spring for locating the spring.

Preferably, the force application shaft is in a cross shape.

As a preferred solution, the spring presses the elastic sensitive element through a seat.

The spring presses the seat against the elastic sensitive element such that thrust surface of the elastic sensitive element increases, and the force on each unit area of the elastic sensitive element decreases; therefore, the resistance-type pressure sensor is not liable to compression failure, prolonging service lift of the elastic sensitive element.

As a preferred solution, the seat includes a pressure application member contacted with the elastic sensitive element and a seat locating member protruding into the spring, the pressure application member and the seat locating member both being columned and an outer diameter of the pressure application member being larger than an outer diameter of the spring.

Specifically, the force applied to the seat is realized in two ways; the first way refers to that the force is transmitted to the seat through the spring, which means when the force application shaft of the button is under pressure, the spring locating shaft of the button is never contacted with the spring locating shaft of the seat; The second way refers to that the force is applied to the seat through the button, which means when the force application shaft of the button is under pressure, the spring locating shaft of the button presses the spring locating shaft of the seat directly after the spring is compressed by the button.

As a preferred solution, the resistance-type pressure sensor is located inside the base, two terminals of the resistance-type pressure sensor passing through a baseplate of the base and being connected to the PCB.

As a preferred solution, the resistance-type pressure sensor is detachably installed on the baseplate of the base and located outside the base, a baseplate hole through which the pressure application member may pass is arranged in the baseplate of the base corresponding to the spring, which pressure application member presses the elastic sensitive element.

By installing the resistance-type pressure sensor detachably outside the base, an operator may have the resistance-type pressure sensor changed quickly when the resistance-type pressure sensor is not capable of working properly.

Preferably, in order to avoid the seat from slipping off the base, one end of the seat locating member close to the pressure application member is provided with a shaft shoulder with an outer diameter larger than the baseplate hole.

As a preferred solution, an outer surface of the elastic sensitive element is coated with a plastic film for protecting the elastic sensitive element from ambient damage.

As a preferred solution, a through hole having a diameter smaller or identical to an inner diameter of the spring is arranged in the elastic sensitive element corresponding to an inner chamber of the spring.

By arranging the through hole in the elastic sensitive element corresponding to the inner chamber of the spring, the spring may press the elastic sensitive element, and save material for the elastic sensitive element, which substantially reduces manufacturing cost of the elastic sensitive element.

As a preferred solution, the resistance-type strain gauges inside the elastic sensitive element is arranged on the periphery of the through hole evenly.

By arranging the resistance-type strain gauges inside the elastic sensitive element on the periphery of the through hole evenly, the spring can press the resistance-type strain gauge to the utmost extent, such that the elastic sensitive element may sense the pressure changes applied thereto properly.

As a preferred solution, a static sheet and a movable sheet installed inside the base are further included, which movable sheet includes a movable sheet body, a contacting member and push sheets, a top end of the movable sheet body being bent downwards and extended to form the contacting member, two sides of the contacting member extending to form the push sheets respectively; the button core extends towards a sidewall of the movable sheet and protrudes outwards to form a push block for pushing the push sheets.

As a preferred solution, the button core is of detachable separated structure, including a core board connecting the force application shaft with the elastic locating shaft, and a driven member fitting with the core board; the receiving cavity is arranged in a lower end of the core board, while the push block is arranged on an outer sidewall of the driven member; the core board and the driven member are slideably connected with each other, and respectively provided with a first limit plate and a second limit plate for avoiding the core board and the driven member from detaching from each other, the first limit plate and the second limit plate being detached from each other or abutted against each other as the button core slides; the core board is provided with a first sounder, and the driven member is provided with a second sounder cooperated with and impacted on the first sounder to make a sound; the first sounder and the second sounder are abutted against each other as the button core is compressed and slides downwards, and detached from each other as the button core returns.

Specifically, when a force is applied to the force application shaft such that the button core is pressed downwards, the first sounder of the core board impacts the second sounder of the driven member to make a sound as the button core is pressed and slides downwards; therefore, there is a sound as a user strikes on the keyboard, such that the user may obtain better hand feeling while operating, and be aware of the striking effect clearly at the same time.

Furthermore, a containing channel running from top surface to bottom surface of the driven member is provided in central area of the driven member, a second limit plate being arranged on an inner wall of the containing channel, and lower end of the driven member protruding into the containing channel; the first limit plate is located below the second limit plate, a lower end of the driven member extending downwards to form an elastic arm; a free end of the elastic arm is bent and extended to form the first limit plate; the first sounder is located above the driven member, and the second sounder is located on top end of the driven member.

Beneficial effects of the present application are as follows: the resistance strain gauge is a resistor. Under static condition, the resistance strain gauge has a high resistance; therefore, current inside the two leads is very low, and the keyboard switch is not capable of conducting. When a pressure is applied to an effective area of the elastic sensitive element, the resistance of the resistance strain gauge decreases as the pressure increases. The keyboard switch conducts when the resistance decreases to a certain extent. As the resistance of the resistance strain gauge decreases, current of the keyboard switch increases accordingly, such that a player may adjust moving speed of a person or an object in a computer game by pressing the keyboard switch with an appropriate pressure. Compared with the prior art, on the one hand, poor contact of the keyboard switch caused by contact deformation and oxidation is avoided, such that the service life of the keyboard switch is prolonged; and on the other hand, linear current input and output of the keyboard switch can be realized, and the keyboard switch can be turned on only by using a very small force, such that the sensitivity and universality of the keyboard switch are improved.

1. Base;
11. Baseplate hole;
2. Upper cover;
3. Spring;
4. Button;
41. Button core;
411. Core board;
4111. First limit plate;
4112. First sounder;
4113. Elastic arm;
412. Driven member;
4121. Second limit plate;
4122. Second sounder;
42. Force application shaft;
43. Elastic locating shaft;
44. Push block;
5. Resistance-type pressure sensor;
51. Elastic sensitive element;
52. Resistance strain gauge;
53. Terminal;
54. Lead;
6. PCB;
7. Seat;
71. Pressure application member;
72. Seat locating member;
73. Shaft shoulder;
8. Movable sheet;
81. Movable sheet body;

82. Contacting member;
83. Push sheet;
9. Static sheet.

DETAILED DESCRIPTION OF THE PREFERRED EMBODIMENT

Technical solutions of the present application will be described in detail hereinafter with reference to the accompanying drawings and specific embodiments below.

First Embodiment

Figure 1:
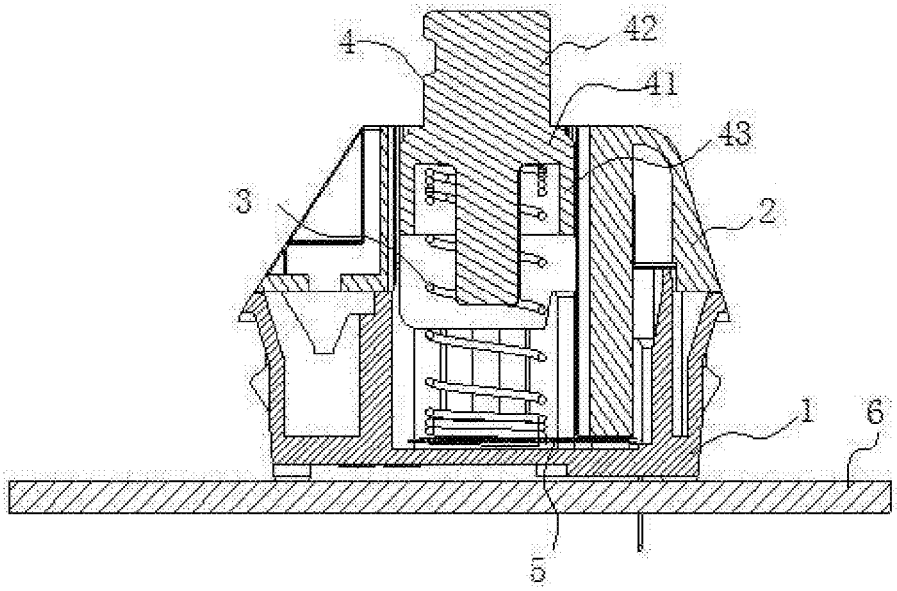
FIG. 1 illustrates a sectional view of a keyboard switch according to a first embodiment of the present application.
Figure 2:
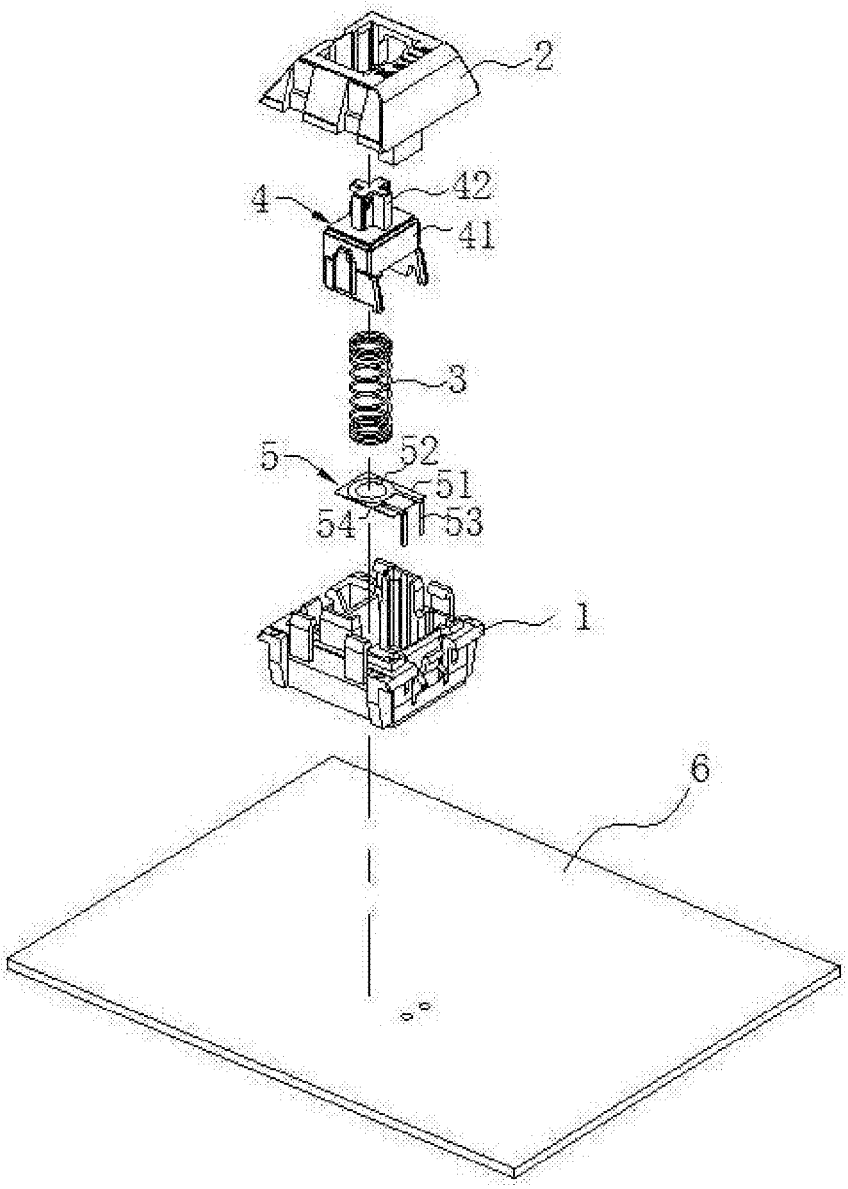
FIG. 2 illustrates an explosive view of the keyboard switch according to the first embodiment of the present application.

As shown in FIGS. 1-2, a keyboard switch including a base 1, a resistance-type pressure sensor 5 installed on the base 1, a spring 3 arranged in the base 1 and capable of being pressed on the resistance-type pressure sensor 5, a button 4 which presses the spring 3 and is in sliding fit with the base 1, and an upper cover 2 which presses the button 4 and is adaptive to the base 1 is provided by the first embodiment, in which the resistance-type pressure sensor 5 includes two terminals 53 and an elastic sensitive element 51, the elastic sensitive element 51 being internally provided with a resistance strain gauge 52 having a resistance value directly proportional to a pressure applied to the elastic sensitive element 51, and two leads 54 extending outwards from the resistance strain gauge 52; one ends of the two terminals 53 are respectively connected to the two leads 54, and the other ends of the two terminals 53 are both connected to a PCB 6.

Specifically, the resistance strain gauge 52 is a resistor. Under static condition, the resistance strain gauge 52 has a high resistance; therefore, current inside the two leads 54 is very low, and the keyboard switch is not capable of conducting. When a pressure is applied to an effective area of the elastic sensitive element 51, the resistance of the resistance strain gauge 52 decreases as the pressure increases. The keyboard switch conducts when the resistance decreases to a certain extent. As the resistance of the resistance strain gauge 52 decreases, current of the keyboard switch increases accordingly, such that a player may adjust moving speed of a person or an object in a computer game by pressing the keyboard switch with an appropriate pressure. On the one hand, poor contact of the keyboard switch caused by contact deformation and oxidation is avoided, such that the service life of the keyboard switch is prolonged; and on the other hand, linear current input and output of the keyboard switch can be realized, and the keyboard switch can be turned on only by using a very small force, such that the sensitivity and universality of the keyboard switch are improved.

The button 4 includes a button core 41, a force application shaft 42 for applying force on the button 4 being arranged above the button core 41, and a receiving cavity for receiving an upper end of the spring 3 being arranged at a lower end of the button core 41. A spring locating shaft 43 is arranged in the receiving cavity, one end of the spring locating shaft 43 being connected to the button core 41, and the other end of the spring locating shaft 43 protruding into the spring 3 for locating the spring 3.

Preferably, the force application shaft 42 is in a cross shape.

In the present embodiment, the resistance-type pressure sensor 5 is located inside the base 1, two terminals 53 of the resistance-type pressure sensor 5 passing through a baseplate of the base 1 and being connected to the PCB 6.

The resistance strain gauge 52 is a wire strain gauge or a foil strain gauge. In the present embodiment, the resistance strain gauge 52 is a wire strain gauge.

Preferably, the resistance strain gauge 52 is made of silver wire which is typographically fixed in the elastic sensitive element 51.

Second Embodiment

Figure 3:
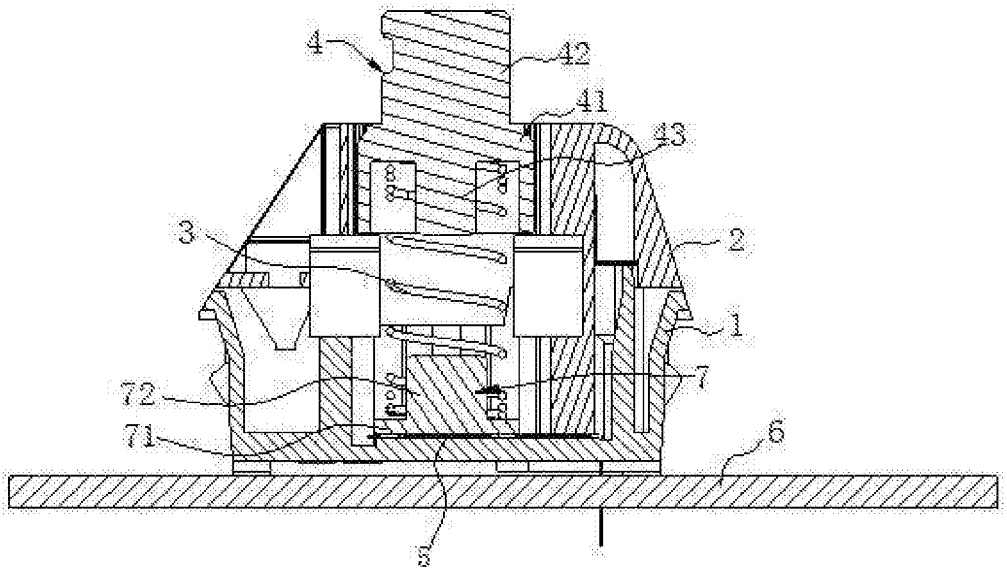
FIG. 3 illustrates a sectional view of the keyboard switch according to a second embodiment of the present application.
Figure 4:
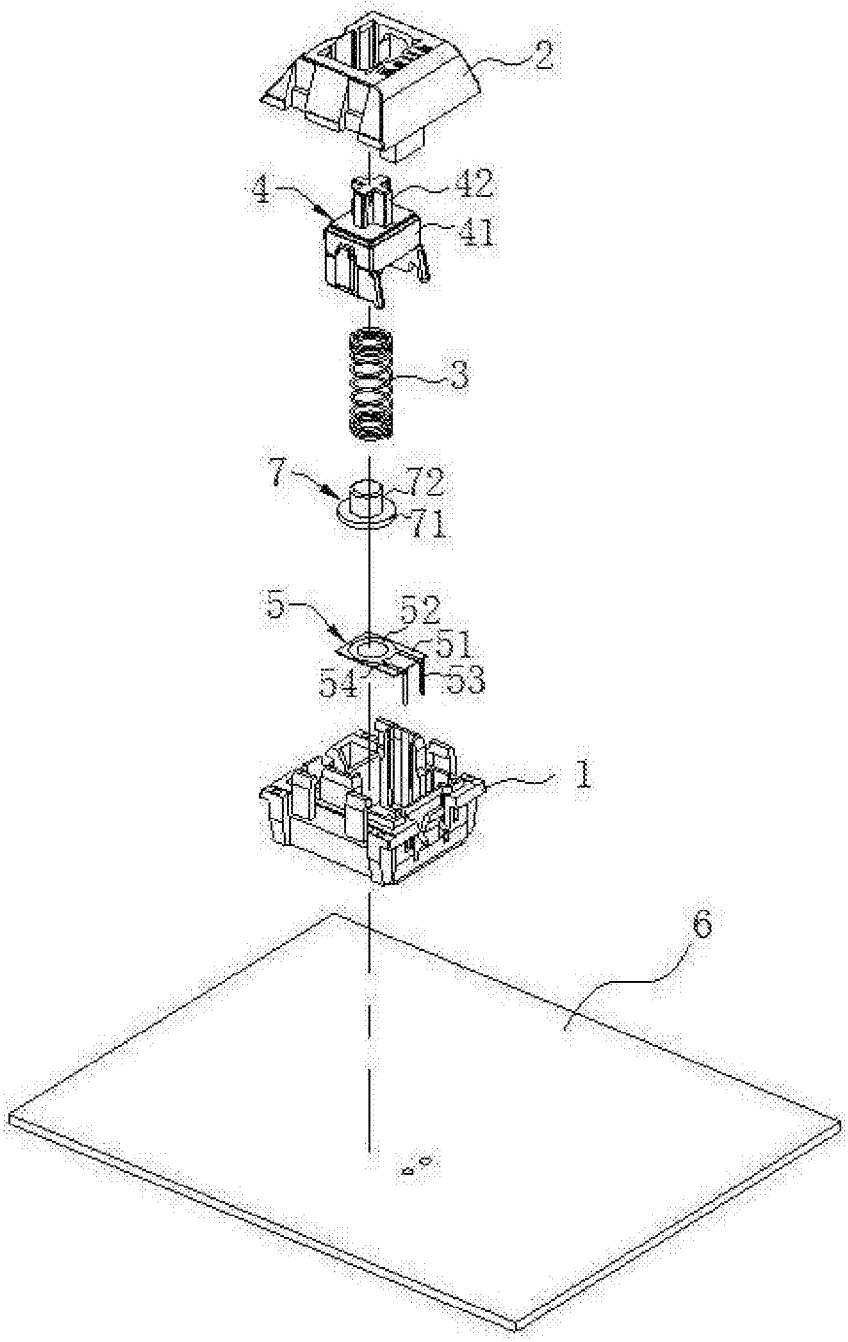
FIG. 4 illustrates an explosive view of the keyboard switch according to the second embodiment of the present application.

As shown in FIGS. 3-4, different from the first embodiment, the spring 3 in the second embodiment presses the elastic sensitive element 51 through a seat 7 instead of pressing the resistance strain gauge 52 directly.

The spring 3 presses the seat 7 against the elastic sensitive element 51 such that the thrust surface of the elastic sensitive element 51 increases, and the force on each unit area of the elastic sensitive element 51 decreases; therefore, the resistance-type pressure sensor 5 is not liable to compression failure, prolonging service lift of the elastic sensitive element 51.

The seat 7 includes a pressure application member 71 contacted with the elastic sensitive element 51 and a seat locating member 72 protruding into the spring 3, the pressure application member 71 and the seat locating member 72 both being columned and an outer diameter of the pressure application member 71 being larger than an outer diameter of the spring 3.

In the present embodiment, the force applied to the seat 7 can be realized in two ways. The first way refers to that the force is transmitted to the seat 7 through the spring 3, which means when the force application shaft 42 of the button 4 is under pressure, the spring locating shaft 43 of the button 4 is never contacted with the spring locating shaft 43 of the seat 7. The second way refers to that the force is applied to the seat 7 through the button 4, which means when the force application shaft 42 of the button 4 is under pressure, the spring locating shaft 43 of the button 4 presses the spring locating shaft 43 of the seat 7 directly after the spring 4 is compressed by the button 4.

Third Embodiment

Figure 5:
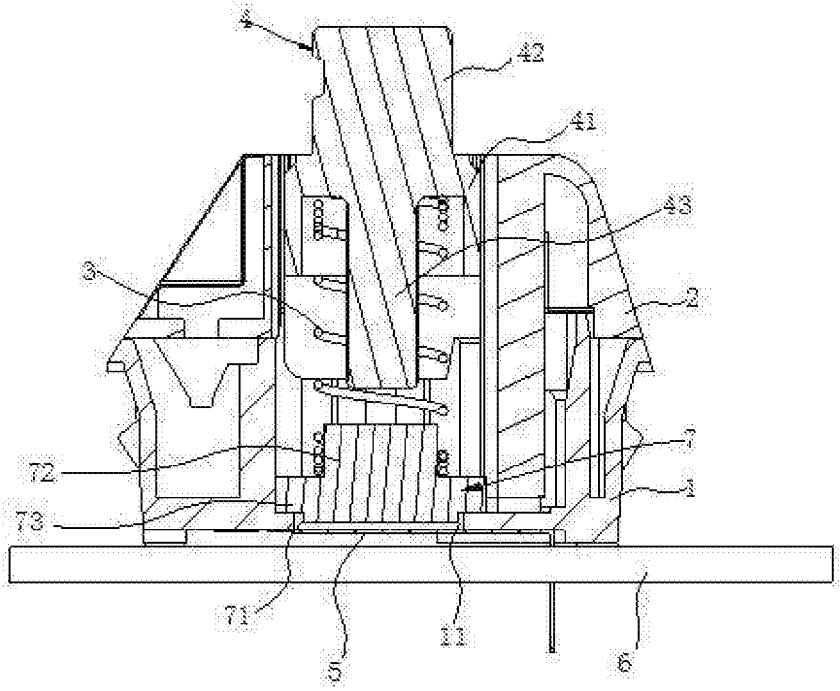
FIG. 5 illustrates a sectional view of the keyboard switch according to a third embodiment of the present application.
Figure 6:
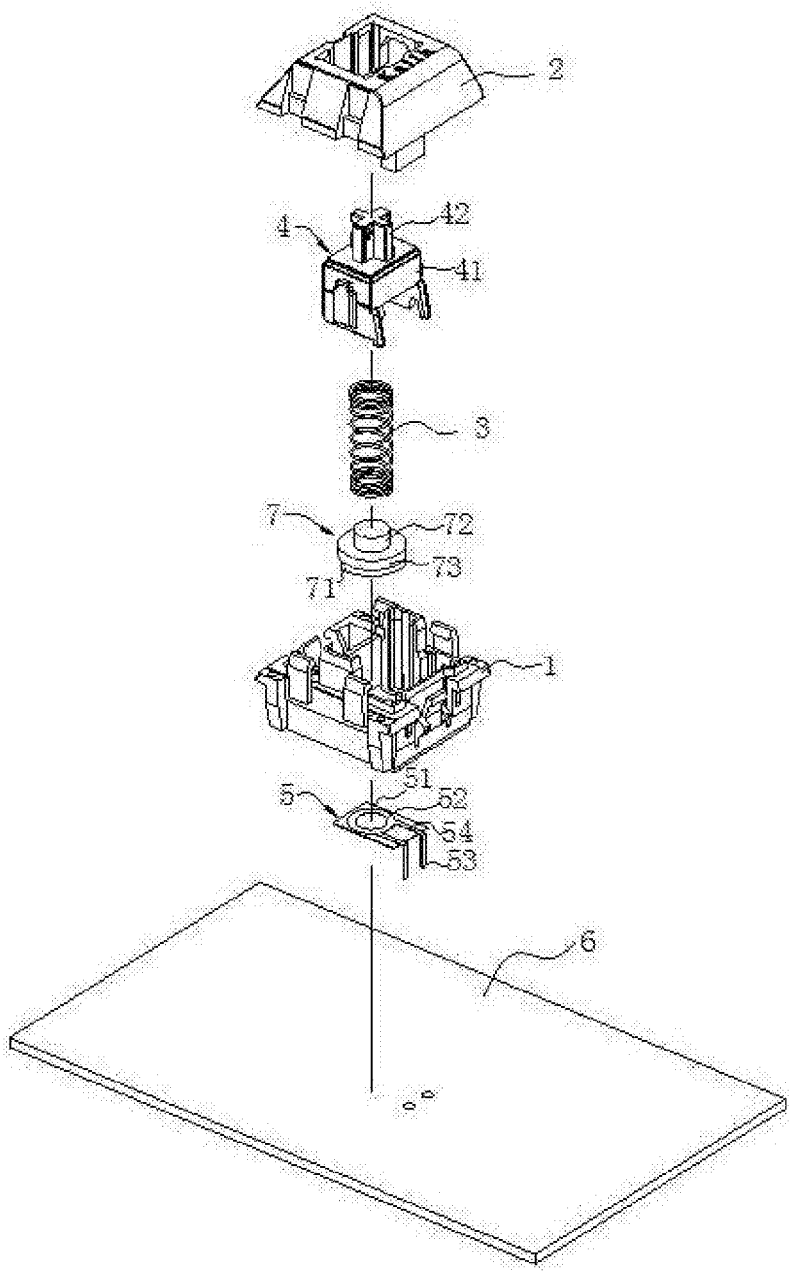
FIG. 6 illustrates an explosive view of the keyboard switch according to the third embodiment of the present application.

As shown in FIGS. 5-6, different from the second embodiment, the resistance-type pressure sensor 5 is detachably installed on the baseplate of the base 1 and located outside the base 1, a baseplate hole 11 through which the pressure application member 71 may pass is arranged in the baseplate of the base 1 corresponding to the spring 3, which pressure application member 71 presses the elastic sensitive element 51.

By installing the resistance-type pressure sensor 5 detachably outside the base 1, an operator may have the resistance-type pressure sensor 5 changed quickly when the resistance-type pressure sensor 5 is not capable of working properly.

In order to avoid the seat 7 from slipping off the base 1, one end of the seat locating member 72 close to the pressure application member 71 is provided with a shaft shoulder 73 with an outer diameter larger than the baseplate hole 11.

Fourth Embodiment

Different from the first embodiment, an outer surface of the elastic sensitive element 51 in the present embodiment is coated with a plastic film for protecting the elastic sensitive element 51 from ambient damage. The plastic film is a protection film for protecting an electronic product. Surely, the protection film for protecting the elastic sensitive element 51 is not limited to plastic film; those skilled in the art may use other protection film for protecting the elastic sensitive element 51, which is also within the protection scope of the present application.

Fifth Embodiment

Different from the first embodiment, a through hole having a diameter smaller or identical to an inner diameter of the spring 3 is arranged in the elastic sensitive element 51 corresponding to an inner chamber of the spring 3.

By arranging the through hole in the elastic sensitive element 51 corresponding to the inner chamber of the spring 3, the spring 3 may press the elastic sensitive element 51, and save material for the elastic sensitive element 51, which substantially reduces manufacturing cost of the elastic sensitive element 51.

The resistance-type strain gauges 52 inside the elastic sensitive element 51 is arranged on the periphery of the through hole evenly.

By arranging the resistance-type strain gauges 52 inside the elastic sensitive element 51 on the periphery of the through hole evenly, the spring 3 can press the resistance-type strain gauge 52 to the utmost extent, such that the elastic sensitive element 51 may sense the pressure changes applied thereto properly.

Sixth Embodiment

Figure 7:
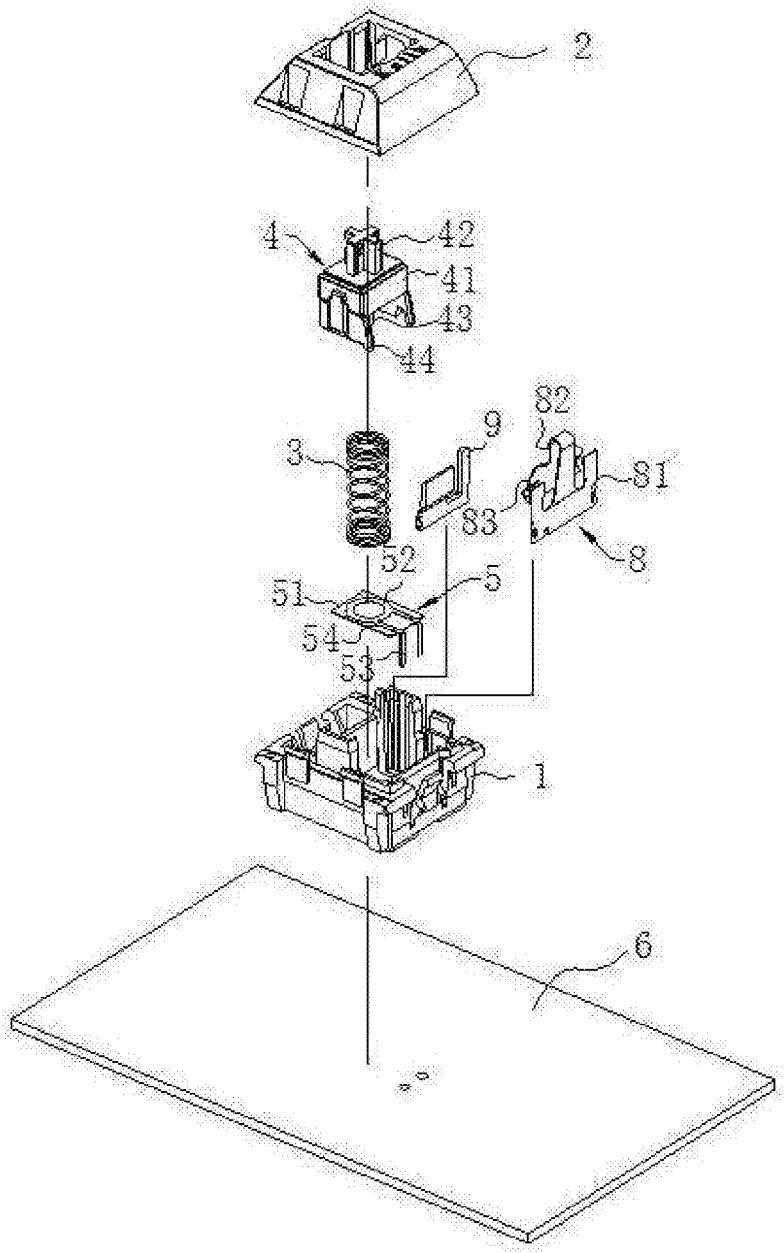
FIG. 7 illustrates an explosive view of the keyboard switch according to a sixth embodiment of the present application.

As shown in FIG. 7, different from the first embodiment, a static sheet 9 and a movable sheet 8 installed inside the base 1 are further included, which movable sheet 8 includes a movable sheet body 81, a contacting member 82 and push sheets 83, a top end of the movable sheet body 81 being bent downwards and extended to form the contacting member 82, two sides of the contacting member 82 extending to form the push sheets 83 respectively. The movable sheet 8 and the static sheet 9 may provide good hand feeling for the keyboard button to some extent.

In the present embodiment, the button core 41 is an integral structure which may not make impact sound.

Seventh Embodiment

Figure 8:
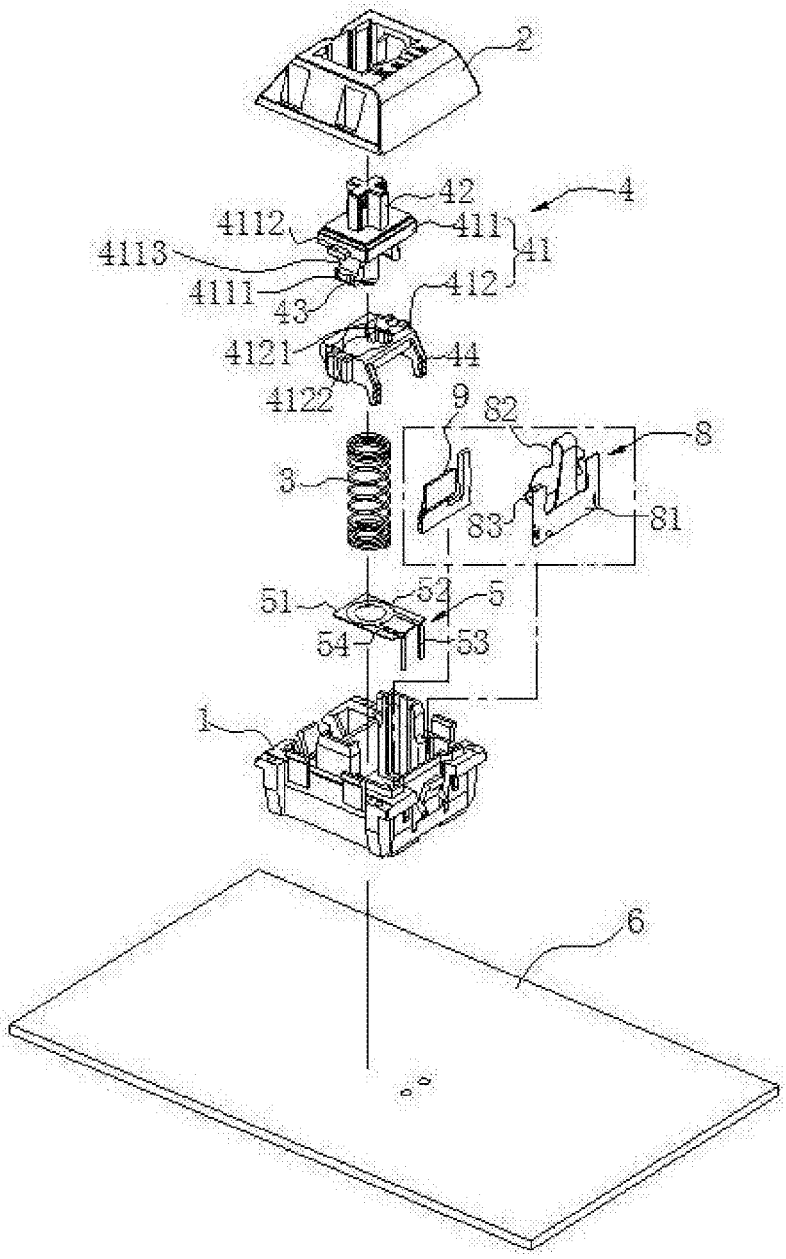
FIG. 8 illustrates an explosive view of the keyboard switch according to a seventh embodiment of the present application.

As shown in FIG. 8, different from the sixth embodiment, the button core 41 in the seventh embodiment is of detachable separated structure, including a core board 411 connecting the force application shaft 42 with the elastic locating shaft 43, and a driven member 412 fitting with the core board 411. A receiving cavity is arranged in a lower end of the core board 411, while a push block 44 is arranged on an outer sidewall of the driven member 412. The core board 411 and the driven member 412 are slideably connected with each other, and respectively provided with a first limit plate 4111 and a second limit plate 4121 for avoiding the core board 411 and the driven member 412 from detaching from each other, the first limit plate 4111 and the second limit plate 4121 being detached from each other or abutted against each other as the button core 41 slides. The core board 411 is provided with a first sounder 4112, and the driven member 412 is provided with a second sounder 4122 cooperated with and impacted on the first sounder 4112 to make a sound. The first sounder 4112 and the second sounder 4122 are abutted against each other as the button core 41 is compressed and slides downwards, and detached from each other as the button core 41 returns.

A containing channel running from top surface to bottom surface of the driven member 412 is provided in central area of the driven member 412, a second limit plate 4121 being arranged on an inner wall of the containing channel, and lower end of the driven member 412 protruding into the containing channel. The first limit plate 4111 is located below the second limit plate 4121, a lower end of the driven member 412 extending downwards to form an elastic arm 4113; a free end of the elastic arm 4113 is bent and extended to form the first limit plate 4111. The first sounder 4112 is located above the driven member 412, and the second sounder 4122 is located on top end of the driven member 412.

Specifically, when a force is applied to the force application shaft 42 such that the button core 41 is pressed downwards, the first sounder 4112 of the core board 411 impacts the second sounder 4122 of the driven member 412 to make a sound as the button core 41 is pressed and slides downwards. Therefore, there is a sound as a user strikes on the keyboard, such that the user may obtain better hand feeling while operating, and be aware of the striking effect clearly at the same time.

Technical principles of the present application are described above in combination of specific embodiments. The description above is merely for explaining the principle of the present application, and should not be explained as limiting the application from any aspect. Alternative embodiments that may be envisaged by those skilled in the art without creative works based on the contents above are all with the protection scope of the present application.

What is claimed is:

1. A keyboard switch, comprising a base, a resistance-type pressure sensor installed on the base, a spring arranged in the base and capable of being pressed on the resistance-type pressure sensor, a button which presses the spring and is in sliding fit with the base, and an upper cover which presses the button and is adaptive to the base, in which the resistance-type pressure sensor includes two terminals and an elastic sensitive element, the elastic sensitive element being internally provided with a resistance strain gauge having a resistance value directly proportional to a pressure applied to the elastic sensitive element, and two leads extending outwards from the resistance strain gauge; one ends of the two terminals are respectively connected to the two leads, and the other ends of the two terminals are both connected to a PCB.

2. The keyboard switch of claim 1, wherein the resistance-type pressure sensor is located inside the base, the two terminals of the resistance-type pressure sensor passing through a baseplate of the base and being connected to the PCB.

3. The keyboard switch of claim 1, wherein an outer surface of the elastic sensitive element is coated with a plastic film for protecting the elastic sensitive element from ambient damage.

4. The keyboard switch of claim 1, wherein a through hole having a diameter smaller or identical to an inner diameter of the spring is arranged in the elastic sensitive element corresponding to an inner chamber of the spring.

5. The keyboard switch of claim 1, wherein the button includes a button core, a force application shaft for applying force on the button being arranged above the button core, and a receiving cavity for receiving an upper end of the spring being arranged at a lower end of the button core; a spring locating shaft is arranged in the receiving cavity, one end of the spring locating shaft being connected to the button core, and the other end of the spring locating shaft protruding into the spring for locating the spring.

6. The keyboard switch of claim 5, wherein the resistance-type pressure sensor is located inside the base, the two terminals of the resistance-type pressure sensor passing through a baseplate of the base and being connected to the PCB.

7. The keyboard switch of claim 5, wherein a static sheet and a movable sheet installed inside the base are further included, which movable sheet includes a movable sheet body, a contacting member and push sheets, a top end of the movable sheet body being bent downwards and extended to form the contacting member, two sides of the contacting member extending to form the push sheets respectively; the button core extends towards a sidewall of the movable sheet and protrudes outwards to form a push block for pushing the push sheets.

8. The keyboard switch of claim 7, wherein the button core is of detachable separated structure, including a core board connecting the force application shaft with the elastic locating shaft, and a driven member fitting with the core board; the receiving cavity is arranged in a lower end of the core board, while the push block is arranged on an outer sidewall of the driven member; the core board and the driven member are slideably connected with each other, and respectively provided with a first limit plate and a second limit plate for avoiding the core board and the driven member from detaching from each other, the first limit plate and the second limit plate being detached from each other or abutted against each other as the button core slides; the core board is provided with a first sounder, and the driven member is provided with a second sounder cooperated with and impacted on the first sounder to make a sound; the first sounder and the second sounder are abutted against each other as the button core is compressed and slides downwards, and detached from each other as the button core returns.

9. The keyboard switch of claim 1, wherein the spring presses the elastic sensitive element through a seat.

10. The keyboard switch of claim 9, wherein the resistance-type pressure sensor is located inside the base, the two terminals of the resistance-type pressure sensor passing through a baseplate of the base and being connected to the PCB.

11. The keyboard switch of claim 9, wherein the seat includes a pressure application member contacted with the elastic sensitive element and a seat locating member protruding into the spring, the pressure application member and the seat locating member both being columned and an outer diameter of the pressure application member being larger than an outer diameter of the spring.

12. The keyboard switch of claim 11, wherein the resistance-type pressure sensor is located inside the base, the two terminals of the resistance-type pressure sensor passing through a baseplate of the base and being connected to the PCB.

13. The keyboard switch of claim 11, wherein the resistance-type pressure sensor is detachably installed on the baseplate of the base and located outside the base, a baseplate hole through which the pressure application member may pass is arranged in the baseplate of the base corresponding to the spring, which pressure application member presses the elastic sensitive element.

* * * * *